United States Patent [19]

Lockard et al.

[11] 3,967,085

[45] June 29, 1976

[54] SINGLE POLE MOMENTARY SWITCH

[75] Inventors: Joseph Larue Lockard, Harrisburg; Bryce Wilson Blair, Hershey, both of Pa.

[73] Assignee: AMP Incorporated, Harrisburg, Pa.

[22] Filed: Nov. 27, 1974

[21] Appl. No.: 527,789

[52] U.S. Cl. ..... 200/302; 200/159 B

[51] Int. Cl.[2] ..... H01H 9/04

[58] Field of Search ..... 200/302, 159 B, 159 R; 277/212 R, 212 C, 212 FB

[56] References Cited

UNITED STATES PATENTS

| | | | |
|---|---|---|---|
| 2,769,882 | 11/1956 | Vitus et al. | 200/302 |
| 2,814,698 | 11/1957 | Miller | 200/159 R |
| 3,054,879 | 9/1962 | Soreng | 200/159 B |

*Primary Examiner*—Gene Z. Rubinson
*Assistant Examiner*—Morris Ginsburg
*Attorney, Agent, or Firm*—Gerald K. Kita

[57] ABSTRACT

A miniature switch utilizes a flexible diaphragm which seals the switch. The diaphragm is compressed sealably against a cover by a spring biased inverted cup which compresses the diaphragm outwardly against the cover. The switch is actuated by pressing the diaphragm to displace the cup against the biasing action of the spring. The cup is conductive and bridges across poles of the switch to complete a momentary switch operation.

3 Claims, 4 Drawing Figures

SINGLE POLE MOMENTARY SWITCH

BACKGROUND OF THE PRIOR ART

The ignition and fuel injection systems of future automobiles are predicted to operate by an electronic system. A miniature momentary switch which is hermetically sealed from engine compartment and other environmental contamination will be incorporated in such an electronic system for use as, a test switch for checking circuit continuity, a reset button to reactivate the system after power shut-off for the purpose of circuit protection, and other momentary and general programming uses. The switch interior is of low volume to prevent the build-up therein of explosive gasses evolved from fuel leakage thus meeting the requirement of an explosion free interior.

Another requirement for the switch is that it be of small size for mounting on an automobile component such as a carburetor or ignition component. Other requirements for the switch are simplicity and low cost without sacrificing reliability and imperviousness to contamination.

OBJECTS OF THE INVENTION

It is accordingly an object of the present invention to provide a miniature momentary switch which is sealed, simple in construction and low in cost.

Another object of the present invention is to provide a miniature momentary switch which is explosion proof and suitable for use in an automobile ignition or fuel injection system.

Other objects and many attendant advantages of the present invention will become apparent from the following detailed description taken in conjunction with the accompanying drawing.

BRIEF DESCRIPTION OF THE PREFERRED EMBODIMENT

A switch according to the present invention includes a dielectric base upon which are mounted a pair of spaced switch poles which advantageously project from the base to provide electrical terminals for mounting the switch in an electrical circuit. A resilient spring is seated on the base and is seated also against an inverted cup. The cup is displaceable against the resilient biasing action of the spring into engagement across the switch poles to momentarily complete an electrical circuit therebetween. Normally the cup is maintained in spaced relationship from the switch poles by the spring. Additionally the cup is biased outwardly against a flexible diaphragm of dielectric material providing a seal for the switch and electrically isolating the conducting cup from the external environment of the switch. A cover is received over the diaphragm sealing the diaphragm to the base and sandwiching the diaphragm against the inverted cup. An operator of the device has access to a portion of the diaphragm through a suitable aperture in the cover. The diaphragm is pressed to displace the cup into engagement on the switch poles to provide a switch operation.

DETAILED DESCRIPTION OF THE PREFERRED EMBODIMENT

Figure 1:
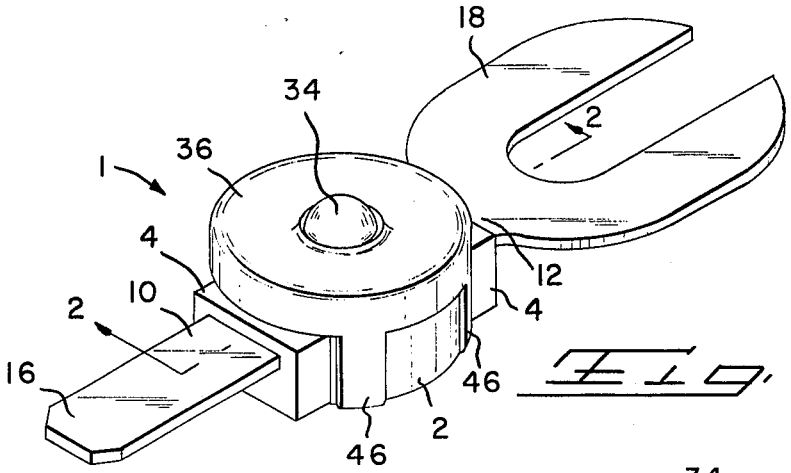
FIG. 1 is an enlarged perspective of the switch according to the present invention.
Figure 2:
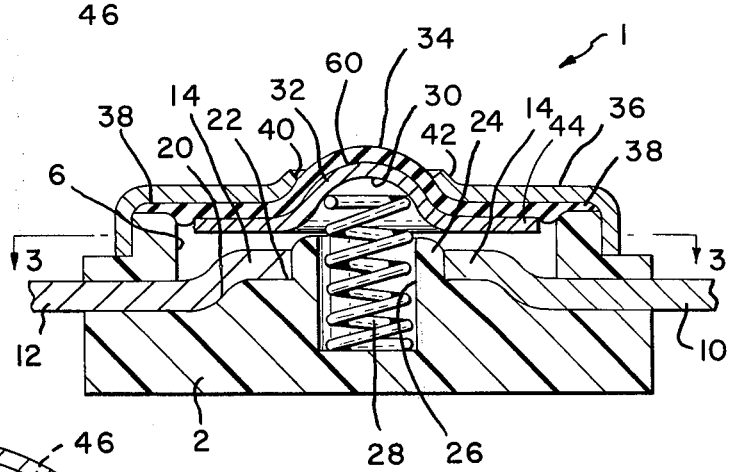
FIG. 2 is a section taken along the line 2—2 of FIG. 1.
Figure 3:
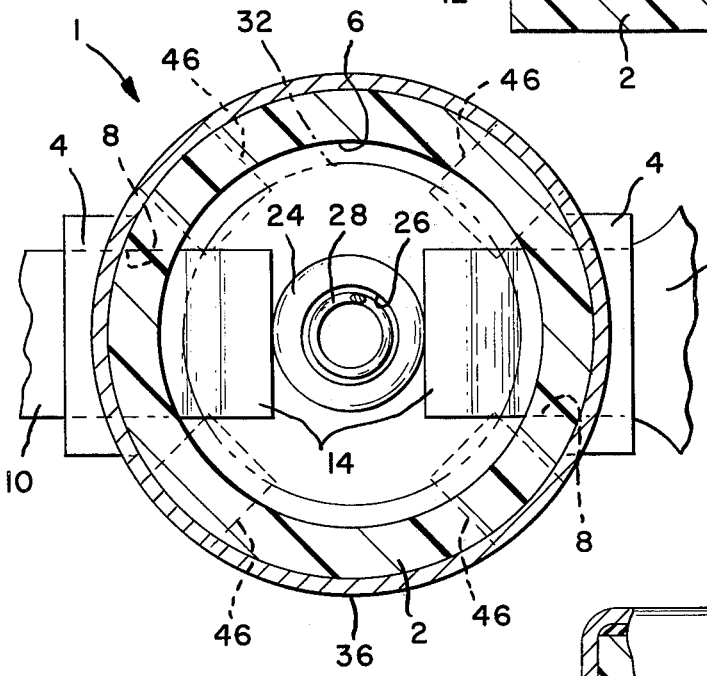
FIG. 3 is a section taken along the line 3—3 of FIG. 2.
Figure 4:
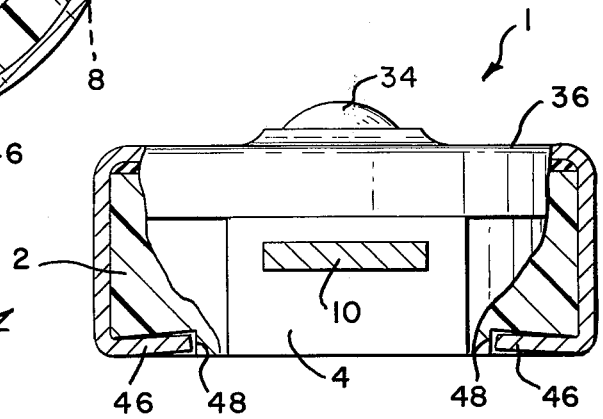
FIG. 4 is an elevation of the switch with parts broken away to illustrate details.

With more particular reference to the drawings there is shown in FIG. 1 generally at 1 a switch having a dielectric base 2 provided with a pair of integral projecting arm portions 4. The base includes a first enlarged central recess 6 communicating with recess portions 8 in the arm portions 4. The switch further includes a pair of switch poles 10 and 12 having first generally rectangular end portions 14 which are seated within the recess portions 8 and which project into the recess portion 6. The other ends 16 and 18 of the terminals or switch poles 10 and 12 project outwardly of the base to provide electrical terminals for mounting and connecting the switch poles to an external circuit (not shown). For example the terminal portion 16 is in the form of a flange-type terminal. The terminal portion 18 is in the form of a slotted tongue-type terminal. The recess 6 includes a bottom wall 20 which is provided with a central raised portion 22 requiring the ends 14 of the switch poles to be curved for mating registration with the bottom wall 20. Initially the terminals 10 and 12 are mounted in spaced relationship from each other with a projecting hub portion 24 integral with the base bottom wall 20 and interposed between the terminals 10 and 12. The projecting hub portion 24 includes a central generally cylindrical recess 26. One end of a coil spring 28 is seated in the bottom of the recess and projects outwardly of the hub 24 and at least partially into the recess portion 6. The other end of the spring 28 is seated against an inverted recess portion 30 of an inverted cup 32. Normally the spring maintains the cup 32 in slight spaced relationship from the terminal end portions 14. The interior space is maintained in as small a volume as possible to minimize the collection of combustible gasses and thereby provide an explosion proof switch. To actuate the switch the cup 32 is displaceable within the recess portion 6, by an operator, in opposition to the biasing action of the spring 28 resiliently collapsing the spring and permitting the cup 32 to electrically engage and bridge across the terminal portions 14 for momentarily completing an electrical circuit therebetween. The cup 32 is accordingly of conducting material and is provided thereover with a flexible diaphragm 34 of dielectric material which electrically isolates the cup 32 from the environment to prevent electrical shorting of the cup to the environment. A metal cover 36 overlies the diaphragm 34 sandwiching the outer periphery 38 of the diaphragm in sealed compression against the outer periphery of the base 2. The switch is thereby sealed from the environment. The cover includes a central aperture 40 which receives partially the inverted recess portion 30 of the cup 32 together with a corresponding portion of the overlying flexible diaphragm 34. The periphery of the aperture 40 is formed with an inverted round to prevent concentration of stresses on the diaphragm. The cup 32 further is provided with an outer relatively broad lip 44. The spring 28 resiliently urges the lip 44 outwardly against the diaphragm 34 and against the cover 36 compressibly sandwiching the diaphragm therebetween to provide a seal.

The cover 36 is provided with a plurality of depending tabs 46 which are bent in gripped relationship over the periphery of the base 2 such that the cover partially surrounds the base and secures itself tightly to the base. The base is provided advantageously with recess portions 48 receiving the tabs therein so the tabs will be recessed within the base.

In operation, the portion of the flexible diaphragm 34 which is exposed through the aperture 40 of the cover 36 may be flexibly depressed by an operator to displace the cup 32 against the resilient biasing action of the spring 28, resiliently collapsing the spring to permit engagement of the cup 32 with the terminal portions 14 to complete momentarily an electrical circuit thereacross. When the diaphragm is released by the operator the spring 28 will resiliently expand and disengage the cup from the terminal portions 14 thereby completing momenary switch operation.

Although preferred embodiments and modifications of the present invention have been described in detail other modifications and embodiments are intended to be covered by the spirit and scope of the appended claims.

What is claimed is:

1. A momentary switch, comprising:

a base having an enlarged recess, a pair of spaced contacts projecting into said recess, said base having an integral hub projecting into said recess, a spring seated in said hub and projecting outwardly into the recess of said base, an inverted cup engaged against the projecting spring and received for displacement within said base recess, said spring normally biasing said cup in a position spaced from said contacts, an encircling lip on said cup, a flexible diaphragm overlying said base and said cup, a cover secured to said base and sandwiching a portion of said diaphragm between said cover and said base to provide a seal, said cover having an aperture exposing a portion of said diaphragm which overlies said cup, said diaphragm having a portion sandwiched between the lip of said cup and said cover, said diaphragm and said cup being displaceable in a direction away from said cover collapsing said spring and engaging said contacts with said cup to complete an electrical circuit across said contacts.

2. The structure of claim 1, wherein said cup includes an inverted recess into which said spring is seated.

3. The structure as recited in claim 2 wherein said cover is secured to said base by tabs integral on said cover and formed in gripped relationship over the periphery of said base.

* * * * *